US010214935B2

(12) United States Patent
Whiteley

(10) Patent No.: US 10,214,935 B2
(45) Date of Patent: Feb. 26, 2019

(54) SUPPORTING TEMPORARY BARRIERS

(71) Applicant: Oxford Plastic Systems Limited, Enstone, Oxfordshire (GB)

(72) Inventor: Christopher Whiteley, Finmere (GB)

(73) Assignee: Oxford Plastic Systems Limited, Enstone (GB)

( * ) Notice: Subject to any disclaimer, the term of this patent is extended or adjusted under 35 U.S.C. 154(b) by 0 days.

(21) Appl. No.: 14/917,206

(22) PCT Filed: Sep. 4, 2014

(86) PCT No.: PCT/GB2014/052665
§ 371 (c)(1),
(2) Date: Mar. 7, 2016

(87) PCT Pub. No.: WO2015/033135
PCT Pub. Date: Mar. 12, 2015

(65) Prior Publication Data

US 2016/0194895 A1 Jul. 7, 2016

(30) Foreign Application Priority Data

Sep. 5, 2013 (GB) ..... 1315822.5
Feb. 7, 2014 (GB) ..... 1402162.0

(51) Int. Cl.
*E04H 12/22* (2006.01)
*E01F 9/692* (2016.01)
*E04H 17/22* (2006.01)

(52) U.S. Cl.
CPC ..... *E04H 12/2269* (2013.01); *E01F 9/692* (2016.02); *E04H 12/22* (2013.01);
(Continued)

(58) Field of Classification Search
CPC . E04H 17/22; E04H 12/2269; E04H 12/2238; E04H 12/2261; E01F 9/692
(Continued)

(56) References Cited

U.S. PATENT DOCUMENTS 7,093,322 B2 * 8/2006 Townend ..... E04G 21/3233 16/400
7,621,691 B2 * 11/2009 Hannah ..... E01F 9/588 40/606.01

(Continued)

FOREIGN PATENT DOCUMENTS

| | | |
|---|---|---|
| AU | 2004208695 | 5/2007 |
| AU | 2009203134 | 6/2012 |
| WO | 2007129067 | 11/2007 |

*Primary Examiner* — Nkeisha Smith
(74) *Attorney, Agent, or Firm* — O'Shea Getz P.C.

(57) ABSTRACT

A base for a temporary barrier has a spigot or socket to receive a fencing pole or to cooperate with a plastics fencing panel. The base has a support portion of plastics material on which is provided the spigot or socket. A pair of stabilizing members of plastics material of low profile extending in opposite directions from the support portion. A stiffening member is connected to each stabilizing member and extends horizontally from adjacent the remote end of one stabilizing member to adjacent the remote end of the other stabilizing member. In one form a pair of metal tubes extend upwardly and are connected to a hollow metal portion through which the stiffening member passes. In another form, a plastics portion projects upwardly and defines a socket.

19 Claims, 6 Drawing Sheets

(52) U.S. Cl.
CPC ..... *E04H 12/2238* (2013.01); *E04H 12/2261* (2013.01); *E04H 17/22* (2013.01)

(58) Field of Classification Search
USPC ..... 248/346.5, 346.01, 346.03, 910, 678, 248/309.1
See application file for complete search history.

(56) References Cited

U.S. PATENT DOCUMENTS

| | | | | |
|---|---|---|---|---|
| 2008/0224016 | A1* | 9/2008 | Defu | E04H 12/2246 248/523 |
| 2014/0054529 | A1* | 2/2014 | Whiteley | E04H 17/22 256/31 |
| 2014/0145046 | A1* | 5/2014 | Layne | E04H 12/2238 248/188.1 |
| 2014/0231737 | A1 | 8/2014 | Whiteley | |
| 2014/0374682 | A1* | 12/2014 | Chilton | E04G 5/14 256/68 |
| 2015/0069313 | A1* | 3/2015 | Christoffer | E04G 21/3223 256/65.14 |
| 2016/0076208 | A1* | 3/2016 | Gerrard | E01F 13/026 404/6 |
| 2016/0258126 | A1* | 9/2016 | Pelletier | E02D 27/42 |

* cited by examiner

Figure 9
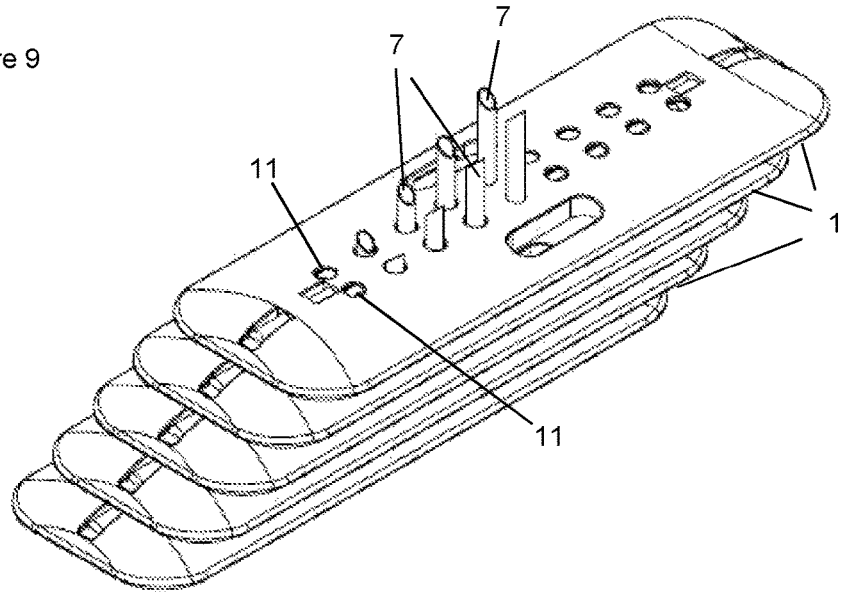
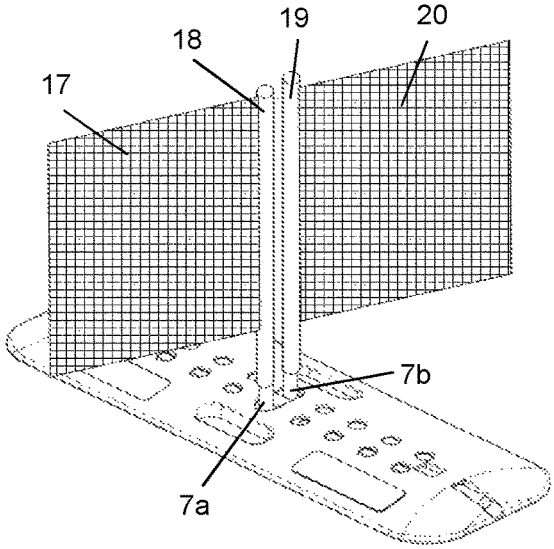
Figure 10
Figure 11
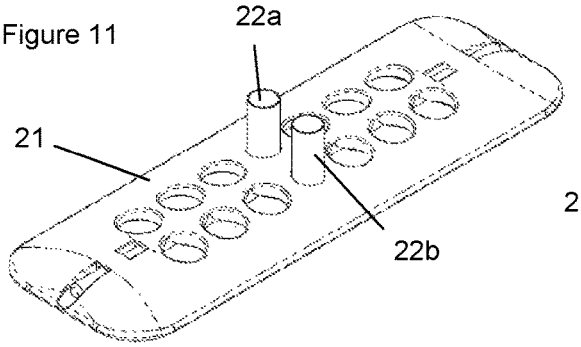
Figure 12
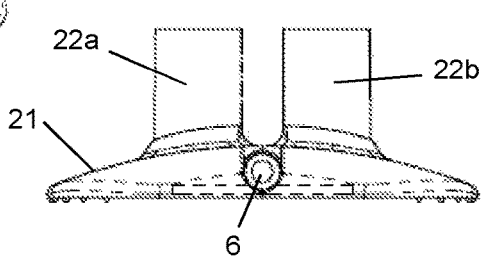

Figure 16
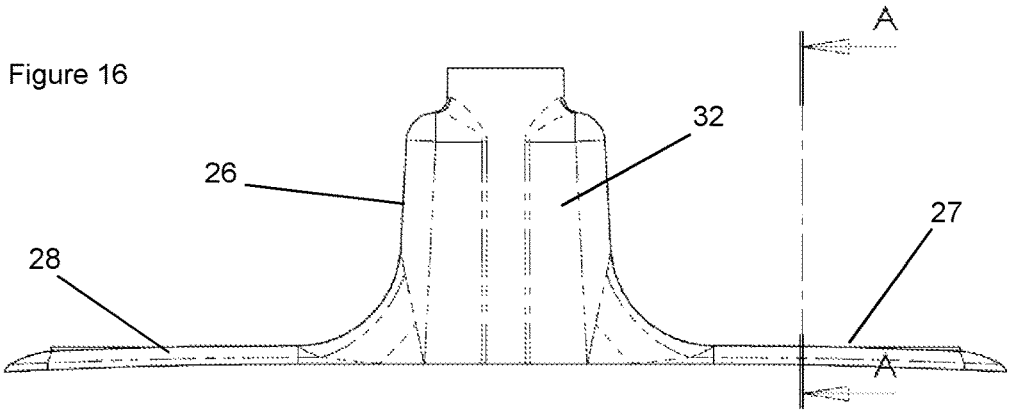
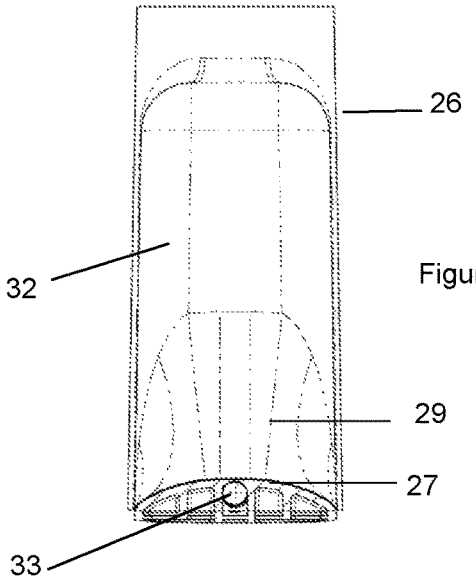
Figure 17
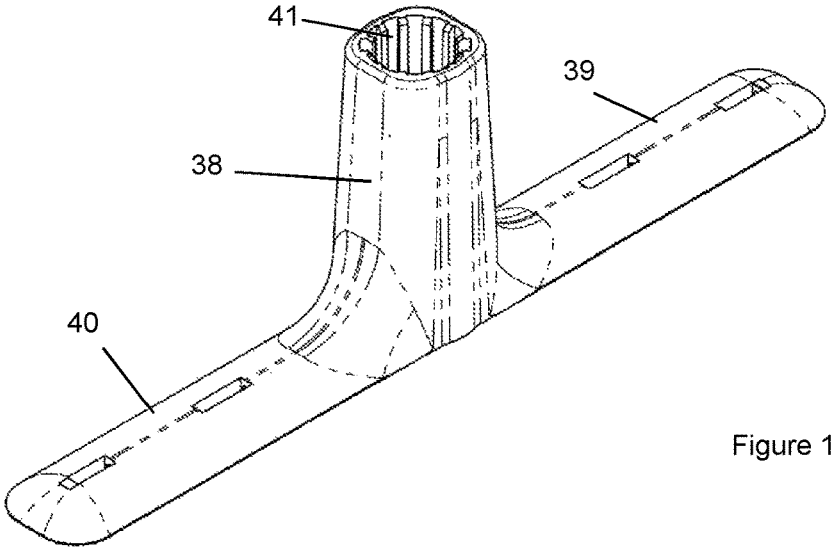
Figure 18

SUPPORTING TEMPORARY BARRIERS

This application is entitled to the benefit of, and incorporates by reference essential subject matter disclosed in PCT Application No. PCT/GB14/52665 filed on Sep. 4, 2014, which claims priority to Great Britain Application No. 1315822.5 filed Sep. 5, 2013 and Great Britain Application No. 1402162.0 filed Feb. 7, 2014, which applications are hereby incorporated by reference.

BACKGROUND OF THE INVENTION

1. Technical Field

This invention relates to a base for supporting a temporary barrier.

2. Background Information

In some case, a temporary barrier such as a fence may be provided with support posts, and a base for supporting a post may have a socket for receiving an end portion of a support post. Alternatively, if an end part of the fence support post is hollow and open ended—for example the support post is in the four of a tube—the base may have a spigot which is received within the end part of the support post. Other barriers such as panels of plastics material may be provided with a support post or spigot and the base will have a socket for receiving an end portion of that. In other cases such a barrier panel of plastics material may be provided with a socket to receive a spigot projecting from a base.

The bases may be made of concrete or of plastics material, such as recycled plastics material. Their function is to prevent unwanted displacement of the support post and to resist the temporary barrier, such as a fencing panel, being knocked or blown over. A problem with such bases is that they may present a trip hazard to pedestrians. A number of solutions have been proposed, such as coloring the base with a bright color.

An object of the present invention is to provide a base which presents a significantly smaller trip hazard.

SUMMARY OF THE INVENTION

According to one aspect of the invention there is provided a base for a temporary barrier, comprising (i) a support portion of plastics material on which is provided an upwardly extending spigot or socket for engaging with a part of the barrier; (ii) first and second elongate, horizontally extending, ground engaging stabilizing members of plastics material and connected to the support portion, the stabilizing members extending in diametrically opposite directions from the support portion to respective remote ends of the stabilizing members; and (iii) an elongate stiffening member which is connected to the first stabilizing member and to the second stabilizing member and extends horizontally from adjacent the remote end of the first stabilizing member to adjacent the remote end of the second stabilizing member.

The use of the stiffening member, provides stiffness to the elongate stabilizing members and means that the profile of the stabilizing members can be kept low so as to reduce the danger of a pedestrian tripping over a foot of the base. In preferred embodiments, therefore, each stabilizing member is of low profile. By low profile is meant that the height of the stabilizing members over major parts of their respective lengths is below a height that would provide a significant risk of tripping for a pedestrian. In accordance with some embodiments of the invention, the height of the stabilizing members over major parts of their respective lengths does not exceed about 40 mm. However, in some preferred embodiments of the invention the stabilizing members have lower heights than 40 mm. In these preferred embodiments, at least over a major part of the length of the stabilizing members from their respective remote ends, the height of the stabilizing member, above the ground on which the base is resting, does not exceed about 35 mm, or about 30 mm, or about 25 mm, or about 20 mm, or about 15 mm or about 12.5 mm. In some embodiments, the preferred maximum height over the major part of the length of each stabilizing members is about 25 mm.

Preferably, the upper surface of the elongate part of each stabilizing member, is profiled so as to avoid abrupt edges, for example having rounded edges and a rounded end, so as to reduce further the risk of tripping.

Where it is said that the height a stabilizing member above the ground on which the base is resting, does not exceed a particular dimension, in some embodiments this refers to not exceeding that dimension at least for a length of the elongate part of the stabilizing member from its end to a point which at least about 95% of the length of the stabilizing member from its remote end, or about 90%, or about 85% or about 80% where about 75%, or about 70%, or about 65%, or about 60%, or about 55%, or about 50%.

Where it is not possible to define an exact length of a stabilizing member, for example because it is not a separate element of the base, the above references to the length of the stabilizing member from its remote end are references to the distance from the remote end of the stabilizing member to the upwardly extending axis of the spigot or socket of the base.

The two stabilizing members may be of the same longitudinal extent, or the arrangement may be asymmetrical. The length of the stabilizing members will depend on the application for which the base is intended, and will be chosen to prevent tipping over of the barrier with which the base is to be used.

The stiffening member serves to reinforce the stabilizing members. The stiffening member may be in the form of a rod or a tube. The stiffening member may be of a suitable material to so as to be substantially rigid, or to be semi-rigid so as to have a sufficient degree of flexibility to assist in assembly of the base. For example the member may be of a metal such as steel. However, in preferred embodiments, the member is of a fiber reinforced plastic material. Preferably the member is manufactured by a pultrusion technique. Such a member may comprise fibers, for example of glass or carbon, in a suitable resin such as a vinyl ester resin. Such members have been used in the reinforcement of concrete. For reasons of cost, it is preferred to use glass fibers in a resin matrix, formed by pultrusion. Generally such a stiffening member will have increased resilience as compared to metal members.

As noted above, the stiffening member may be in the form of a rod. The rod may have a hollow center, so as to be tubular. The stiffening member may have any desired cross section, such as being circular, oval, square, oblong, flat, cruciform or any other desired cross section, whether solid or hollow.

The engagement of the base with a barrier may be directly, for example by means of a socket of the base receiving a spigot of the barrier panel; or a spigot of the base engaging with a socket of the barrier panel; or the engagement with the barrier may be by way of a socket of the base receiving the end of a support pole for a barrier or a fence; or a spigot of the base engaging within a hollow support pole of a barrier or fence.

There may be a plurality of spigots or sockets on the base. This is applicable in particular where the bas engages with poles of a fence since if tow spigots or bores are provided the base will provide a junction between two fencing panels.

The or each spigot or socket may be formed by plastics material, by metal, or by a combination of materials.

Some embodiments of the present invention involve the use of an upwardly extending member providing a spigot for the base which engages in a hollow fencing support pole. However, some embodiments use an upwardly extending member which is hollow so as to serve as a socket to receive e.g. a fence pole. Preferably, there are two spaced upwardly extending members, and others could be provided if desired.

The or each upwardly extending member may be made of metal, such as steel. The or each upwardly extending member may be in the form of a tube. The free end of the or each upwardly extending member may be chamfered to facilitate insertion into a support tube for fencing or the like. Alternatively, it could taper and this could be provided by using a plurality of upwardly extending member portions of different external diameter, joined together in series. Similarly if a socket is provided, this could be wider initially to assist insertion of a fence pole or the like, and will then narrow to provide a secure seating of the pole. Again this could be achieved by using a plurality of upwardly extending member portions of different external diameter, joined together in series.

In a preferred arrangement, the or each upwardly extending member has a lower end which is connected to an open ended hollow member extending in the direction of the stiffening member, through which the stiffening member passes. The or each upwardly extending member then passes upwardly through an associated aperture in the support portion of the base. If there is a plurality of upwardly extending members, there may be an individual aperture for each upwardly extending member or there may be a common aperture for a plurality of upwardly extending members. In some embodiments, the lower surface of the hollow member is flat. The hollow member may for example be a portion of box section. The cross section of the hollow member may be rectangular, for example square. However the cross section of the hollow member may be of any other cross section, such as circular, elliptical or polygonal. The hollow member may be of metal such as steel.

If an upwardly extending member defining a spigot or socket is metal, and the hollow member is also metal, then the two may be joined together by welding. In one embodiment, there are two metal upwardly extending members joined to a common hollow member, on opposite sides thereof, to form a metal component. An equivalent component could instead be a molded or fabricated component of other material such as plastics. Assembly is simple in such arrangement, with the or each upwardly extending member being pushed through the aperture in the support member, and the stiffening member being pushed into position, through the hollow member.

Preferably, the support portion of the base and the first and second stabilizing members are integrally formed, for example being a single molding of plastics, for example formed by injection or blow molding. In some embodiments, particularly those for use with a barrier panel of plastics rather than a support pole for fencing, the support portion of the base is provided with an integrally formed upwardly extending plastics part which can either define a spigot or socket of the base, or can be provided with a separate socket or spigot member which can be a separately molded member, for example injection molded.

The stabilizing members may be connected to the upwardly extending part of the support portion, part way up, for example by curved transition regions.

The ends of the stabilizing members may be provided with portions which restrain the stiffening member against longitudinal movement when the stiffening member is in position, at last one of the portions being capable of flexion so that the stiffening member can be inserted, and then returning resiliently to keep it in position.

The stabilizing members define feet for the base and could be of an appropriate high visibility color such as yellow or orange.

In some embodiments, there could be a plurality of stiffening members, which are preferably substantially parallel to each other. Each stiffening member would extend from adjacent the remote end of the first stabilizing member to adjacent the remote end of the second stabilizing member.

The stiffening member could extend through a bore or an open recess formed in each stabilizing member.

In some embodiments of the invention, the support portion comprises a ballast member, which serves to provide a ballast weight. Such a ballast member could be of relatively dense material compared to the material of the remainder of the base, for example being relatively inexpensive, relatively low quality plastics material such as recycled PVC. Typically the recycled plastics will be of a grey or black color but would be concealed by an upwardly extending part of the support portion which serves as a cover for the ballast weight. The presence of a ballast weight is particularly useful where the support post for the temporary barrier is a pole of a fencing panels The ballast weight will be of relatively low quality plastics as compared to other components of the base, such as the stabilizing members and the support portion. These other components typically will be of injection or blow molded plastics which is of higher quality.

In some embodiments, the stabilizing members serve as a cover, or at least a partial cover, for the or each stiffening member.

In some embodiments a base with a ballast weight is used with a barrier panel such as a molded plastics panel. However in the case of such panels, the panel itself could be constructed to have a concentration of mass lower down which will serve as a built in ballast so a separate ballast weight is not necessary. In the case of such barriers, which may be provided with means to interlock with other barriers, it may be sufficient to have a single bore which receives a support post for a single panel or a single spigot which engages with the barrier panel.

In some embodiments of the invention, the support portion comprises a ballast member, and serves to provide a ballast weight. The ballast member is of relatively dense material compared to the material of the stabilizing member, for example being the relatively inexpensive, relatively low quality plastics material such as recycled PVC. Typically the recycled plastics will be of a grey or black color.

If the base has an upwardly extending support portion of plastics material, this may cover a ballast weight The upper surface of the base may be provided with apertures, either side of projecting members which provide upwardly extending spigots or sockets, so that the bases can be stacked in an offset configuration with one base having its projecting members passing through the apertures of the base above.

A base in accordance with embodiments of the invention presents a reduced risk of tripping to pedestrians, because the protruding foot is of low profile, preferably has rounded edges, and is preferably brightly colored.

According to another aspect there is provided a base as above described in combination with one or more barrier portions. For example, the base could be in combination with a pole of a fencing panel or in combination with two poles of two fencing panels. Alternatively, the base could be in combination with a panel of a barrier with an integrally provided socket or spigot.

BRIEF DESCRIPTION OF THE DRAWINGS

Some embodiments of the invention will now be described with reference to the accompanying drawings, in which:

FIG. 9 is a perspective view showing a number of bases stacked in an offset manner;

FIG. 10 shows a base in use;

FIG. 11 is a perspective view of a modified base;

FIG. 12 is an end view of the modified base;

FIG. 16 is a side view of the base;

FIG. 17 is a section on the line A-A of FIG. 16;

FIG. 18 is a perspective view of a modified base for receiving a spigot of a barrier;

DETAILED DESCRIPTION

Figure 6:
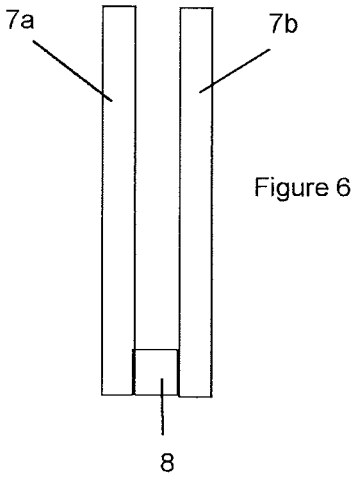
FIG. 6 is an end view of a metal component comprising two spigots and a hollow box section.

Referring now in detail to the Figures, in FIGS. 1 to 7 there is shown a base 1 for receiving fence poles. This base comprises a molded part 2 of plastics, defining an integrally formed central support member 3, first stabilizing member 4 and second stabilizing member 5. The base 1 further comprises a stiffening rod 6 and a pair of metal spigots 7*a* and 7*b* projecting up from the support member. The metal spigots are connected, e.g. by welding to a hollow box section 8 and project upwardly through an aperture 9 in the support member. The stiffening rod 6 passes through and is connected to the stabilizing members 4 and 5 and passes through the hollow box section 8. The stiffening rod passes continuously from adjacent the free end of stabilizing member 4 to adjacent the free end of stabilizing member 5. The free end of FIG. 6 shows the metalwork used, comprising the spigots 7*a*, 7*b* welded to the box section 8.

The rod 6 is of fiber reinforced resin, manufactured by pultrusion.

Apertures 10 are provided to facilitating lifting and manipulation. A series of pairs of apertures 11 are provided along the stabilizing members 4, 5 to assist in stacking, as described below. In each pair the spacing between the apertures 11 matches the spacing between the spigots 7*a* and 7*b*. The pairs of apertures are spaced at regular intervals along the stabilizing members 4, 5.

Figure 7:
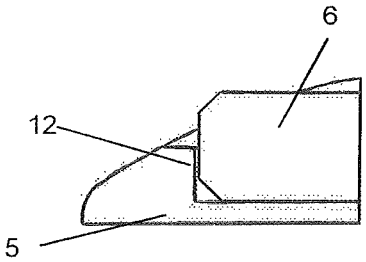
FIG. 7 is an enlarged view of the portion marked A on FIG. 1.

FIG. 7 show how a portion 12 at the remote end of the stabilizing member 5 restricts longitudinal movement of the stiffening rod. The remote end of the stabilizing member flexes to permit insertion of the stiffening rod 6 and then snaps back to hold the stiffening rod 6 in place. A similar structure can be provided at the remote end of the stabilizing member 4 so that the stiffening rod is secured in place.

Figure 8A:
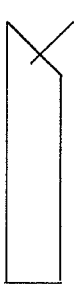
FIGS. 8A, 8B and 8C show alternative spigots.
Figure 8B:
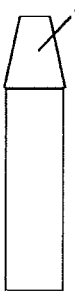
Figure 8C:
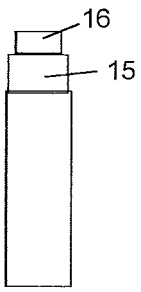

The upper ends of the spigots may be chamfered, as shown at 13 in FIG. 8*a*, to facilitate insertion into a tubular fence post. Alternatively, the spigot may be provided with a tapered end 14 as shown in FIG. 8*b*. FIG. 8*c* shows how an alternative spigot could be provided with a taper by means of spigot portions 15 and 16 of reduced diameter.

FIG. 9 shows a series of bases 1 stacked on each other with the pairs of spigots 7 of each base projecting through the regularly spaced pairs of apertures 11 of the bases above. The bases can thus be stacked in a space saving manner, for storage or transport FIG. 10 shows, diagrammatically, a fence panel 17 with a supporting pole 18 received on one of the spigots 7*a* of the base 1. A second supporting pole 19 is received on the other of the spigots 7*b* and carries a second fence panel 20.

In an embodiment illustrated in FIGS. 11 and 12, instead of spigots a base 21 has upwardly extending socket portions 22*a* and 22*b* which receive a support pole for a barrier such as fencing. Otherwise, the construction corresponds to that of the preceding embodiment.

Instead of a one piece plastic molding, the part 2 of the base could be made of a number of separate moldings that are joined together, such as a central molding defining the support member, which is connected by a joint to one molding defining the stabilizing member 4 and is connected by a joint to one molding defining the stabilizing member 5.

Additional ballast in the form of, for example, prefabricated weights or sandbags for the stabilizing members could be used to provide additional stability if required.

Figure 1:
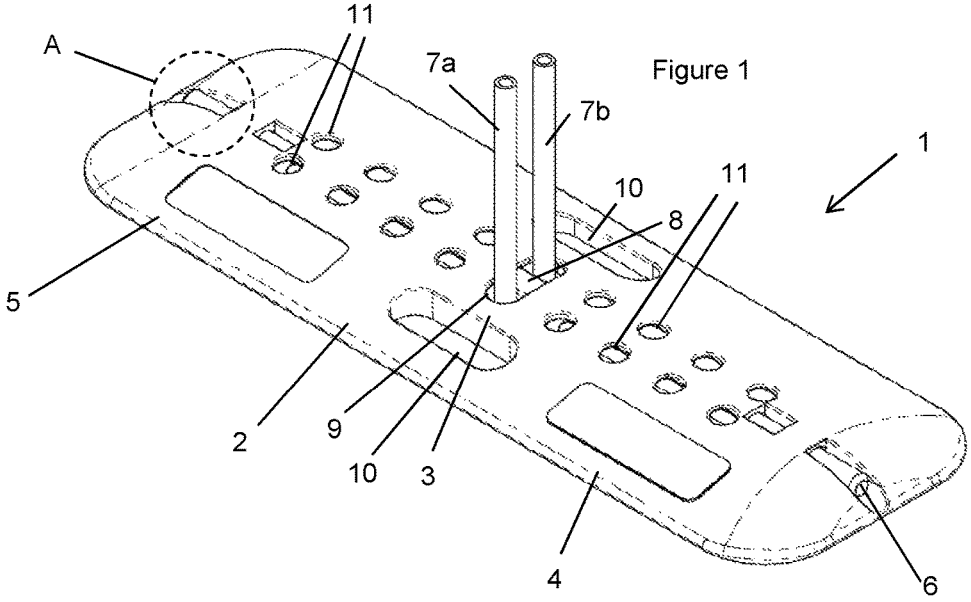
FIG. 1 is a perspective view of a first embodiment of a base in accordance with the invention.
Figure 2:
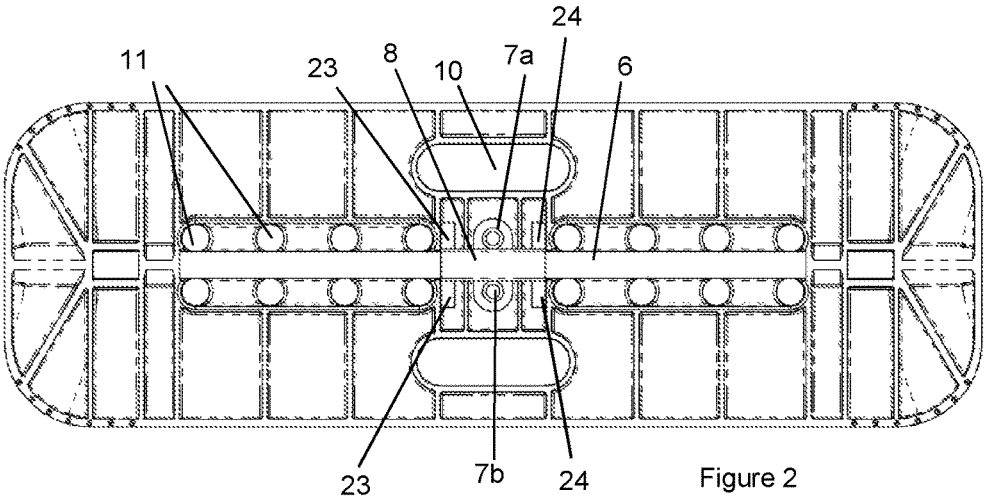
FIG. 2 is a bottom plan view.
Figure 3:
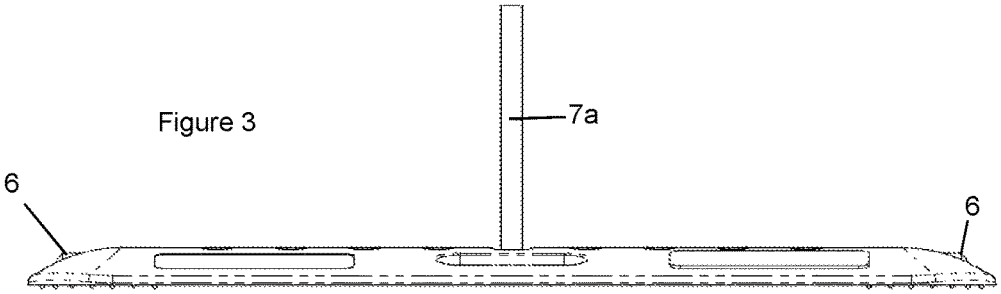
FIG. 3 is a side elevation.
Figure 4:
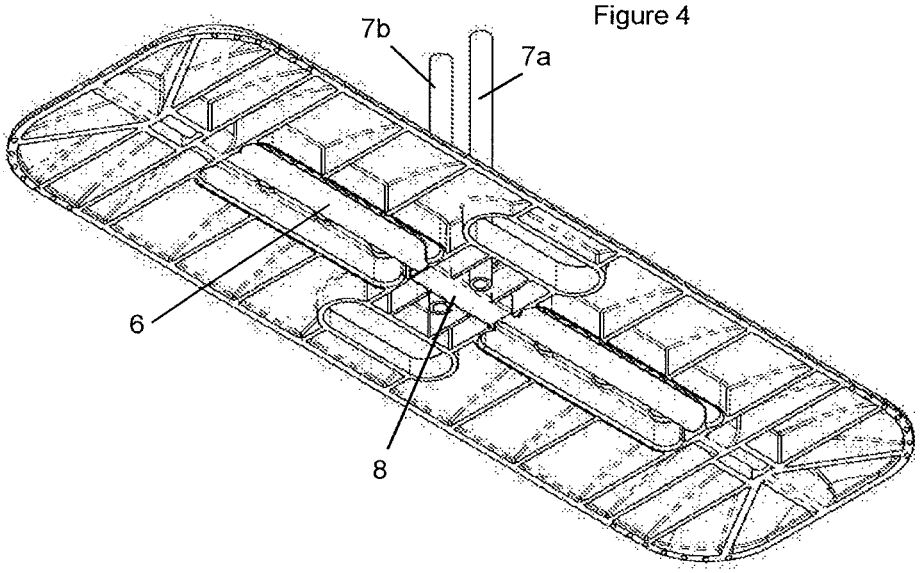
FIG. 4 is an underneath perspective view.
Figure 5:
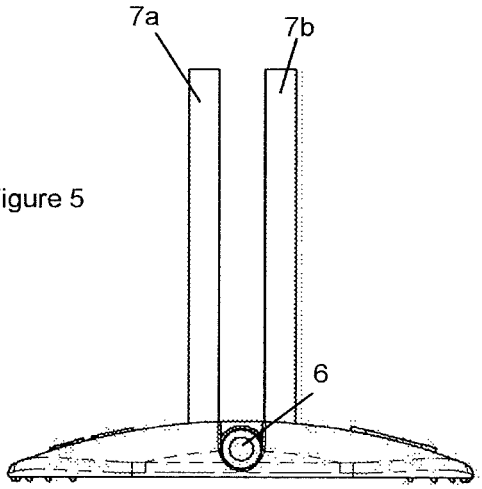
FIG. 5 is an end view.

With reference to FIG. 3, laterally extending metal tabs 23 and 24 could be provided at the ends of box section 8, to engage against portions of the molded plastics part 2 and assist in ensuring stability of the construction.

The plastics part 2 of low profile in the above embodiments, throughout its length. It has rounded edges along its sides and at both ends to reduce further the risks of tripping. The plastics part may also be colored brightly to bring the attention of the base to pedestrians.

Figure 13:
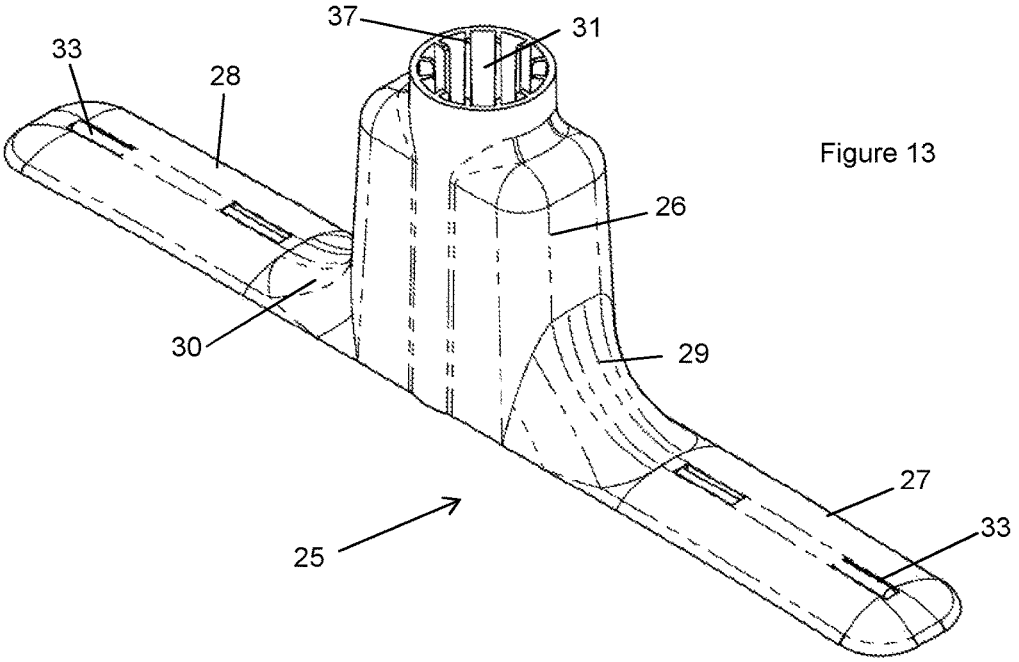
FIG. 13 is a perspective view of a base for receiving a spigot of a barrier.
Figure 14:
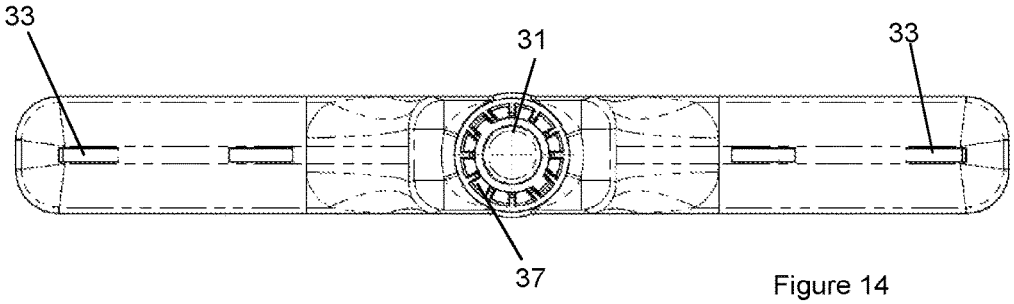
FIG. 14 is a top plan view of the base of FIG. 13.
Figure 15:
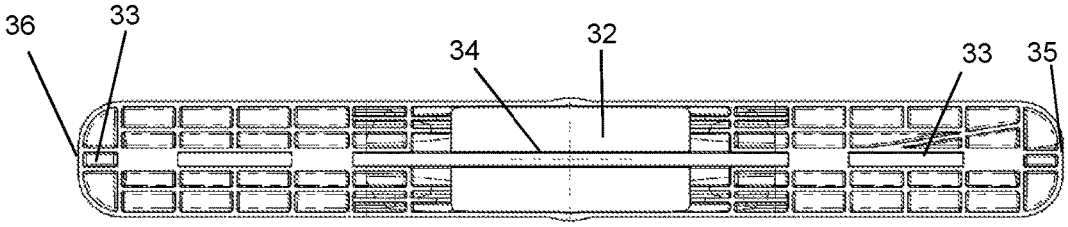
FIG. 15 is an underneath plan view of the base.

FIG. 13 shows another embodiment of the invention, in the form of a base 25 for receiving a spigot portion of, for example, a plastics barrier. The base comprises an integrally molded plastic component defining an upwardly extending support member 26 from which project a stabilizing member 27 and a stabilizing member 28 in diametrically opposed directions. There are curved transition portions 29 and 30 respectively between stabilizing member 27 and support member 26, and stabilizing member 28 and support member 26.

The support member 26 is provided with a socket 31 in the form of a bore passing vertically downwards part way through the support member, with an opening at is upper end. The socket can receive a spigot of a barrier (not shown). The socket could be an integral part of the support member 26, or could be a separate plastics component connected to the support member, for example by co-molding, bonding or any other suitable technique.

In this embodiment, the interior of the support member 26 is provided with a ballast weight in the form of a block 32 of plastics material, such as high density recycled PVC. In some embodiments, part of the bore 31 forming the socket could pass through the ballast weight. The ballast weight could be omitted in some embodiments.

A stiffening rod 33 passes through and is connected to the stabilizing members 27 and 28, and passes continuously from adjacent the free end of stabilizing member 27 to adjacent the free end of stabilizing member 28. The rod passes under support member 26 and in a groove 34 formed in the bottom face of ballast weight 32.

The rod 33 is of fiber reinforced resin, manufactured by pultrusion. The ends of the stabilizing members 27 and 27 are provided with downwardly projecting portions 35 and 36 which prevent movement of the rod out from its position. The ends of the stabilizing members are resilient so that an end can be bent upwardly to permit insertion of the road, and will then flex back to retain it in position. Alternatively an arrangement such as shown in FIG. 7 of the previous embodiment could be used to retain the rod.

At least part of the socket 31 could be provided with a series of circumferentially spaced, radially inwardly extending ridges 37 to engage the surface of a spigot inserted into the socket.

FIG. 18 shows a base which is similar to that of FIGS. 13 to 17, with a support member 38, stabilizing members 39 and 40, a socket 41 in the support member and a stabilizing rod (not shown). In this embodiment, the support member is less substantial than in the previous embodiment because it does not contain a separate ballast weight. This base is for use with a barrier which provides its own ballast weight.

In both the embodiment of FIGS. 13 to 17 and FIG. 18, the major parts of the stabilizing members from their free ends to where they join the support member, are low profile. These parts of the stabilizing members have rounded edges along their sides and at their free ends to reduce further the risks of tripping. The base or at least the stabilizing members may also be colored brightly to bring the attention of the base to pedestrians.

Figure 19:
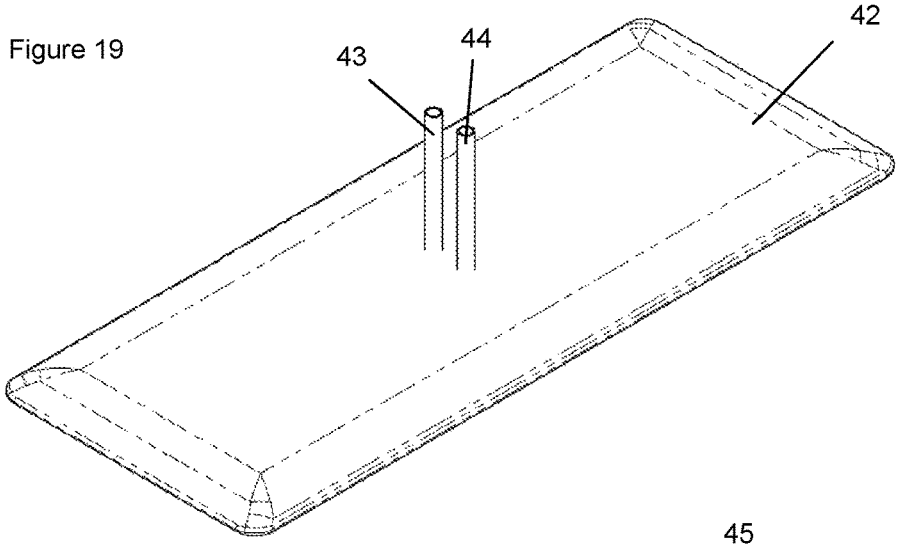
FIG. 19 is a schematic perspective view of another embodiment of a base for receiving fence poles.
Figure 20:
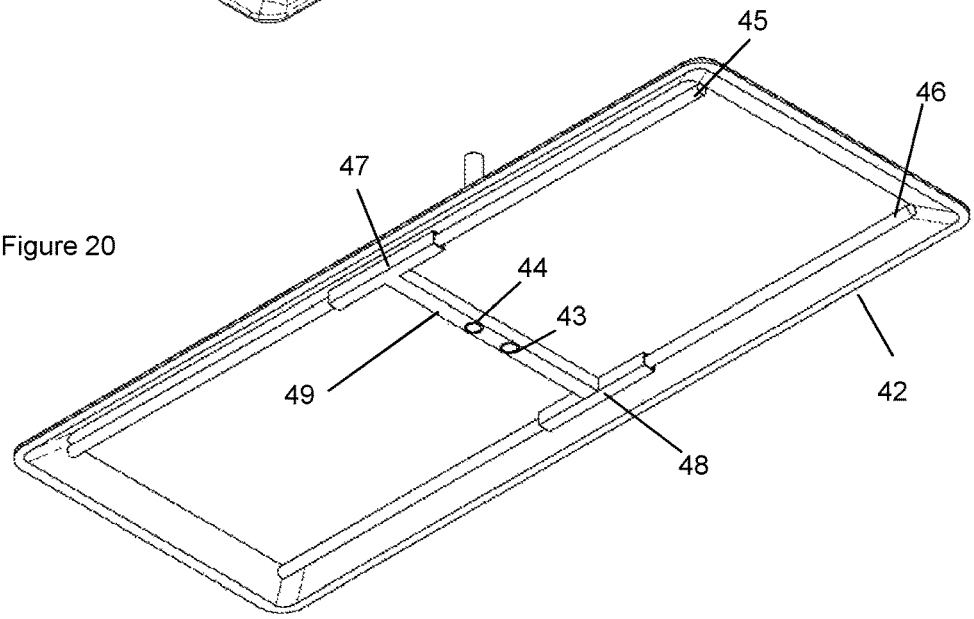
FIG. 20 is an underneath perspective schematic view of the base of FIG. 19.
Figure 21:
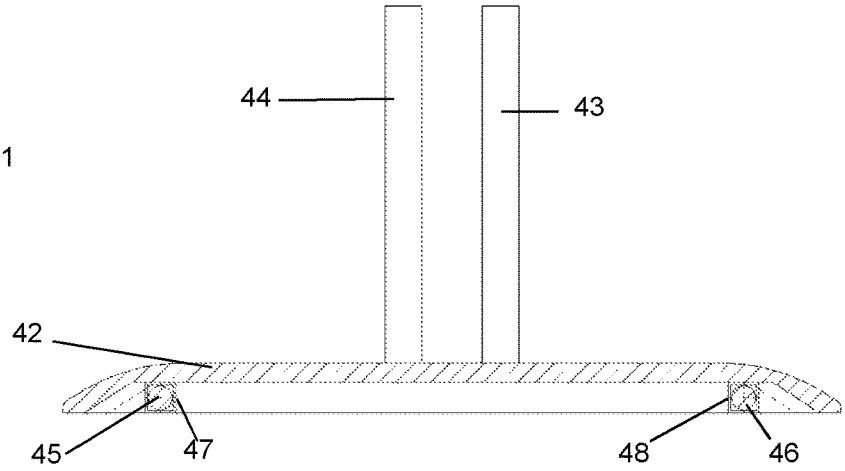
FIG. 21 is a section through the base of FIGS. 19 and 20.

FIGS. 19 to 21 illustrate, in schematic form only a modification of the embodiments of FIGS. 1 to 12. There is a molded plastics component 42 with upwardly projecting metallic spigots or socket 43 and 44. In this embodiment there are two stiffening rods 45 and 46, again preferably of fiber reinforced resin made by pultrusion. Rod 45 passes through a metal box section 47 and rod 46 passes through a metal box section 48. The box sections are interconnected by a metal cross member 49, to which are connected the sockets or spigots 43 and 44, for example by welding, which pass upwardly through apertures in the component 42. In a practical embodiment of such an arrangement, other features of the base would correspond to those of the embodiments of FIGS. 1 to 12, modified as appropriate to account for the fact that there are two stiffening rods rather than one central stiffening rods.

It will be appreciated that the invention can be expressed broadly in a number of different ways.

For example, viewed from another aspect of the invention, there is provided a base for supporting a temporary barrier, the base having a portion for engaging with the barrier, wherein the base comprises: (i) a first member of plastics material, the first member having a bottom part from which the first member extends upwardly to a top part of the first member, the first member defining, at least in part, the portion to engage with the barrier; (ii) a stabilizing member of a plastics material, the stabilizing member having a first part which is connected to the first member and an elongate ground-engaging second part which is connected to the first part and extends horizontally to a region remote from the first member; and (iii) an elongate stiffening member which is connected to the second part of the stabilizing member and extends horizontally from adjacent the bottom of the first member, to adjacent said region remote from the first member.

In some embodiments of this aspect of the invention, there is also provided a second stabilizing member of a second plastics material, the second stabilizing member having a first part which is connected to the first member and an elongate ground-engaging second part which is connected to the first part and extends horizontally to a second region remote from the first member, in the opposite direction to the second part of the first stabilizing member; and the elongate stiffening member is also connected to the second part of the second stabilizing member and extends horizontally from adjacent the base of the first member, to adjacent said second region remote from the first member.

Viewed from another aspect of the invention there is provided a base for supporting a temporary barrier, the base having a portion for engaging with the barrier, wherein the base comprises; wherein the base comprises a central part of plastics material which includes the portion for engaging with the barrier, a pair of elongate, low-profile stabilizing members connected to the central part and extending away from the central part in opposite directions to respective free ends, the stabilizing members being of plastics material, and an elongate stiffening member connected to both stabilizing members and extending continuously from adjacent the free end of one stabilizing member to adjacent the free end of the other stabilizing member.

According to another aspect of the invention there is provided a base for supporting a temporary barrier, the base having a portion for engaging with the barrier, wherein the base comprises: (i) a support member of plastics material, the support member being provided with the portion to engage with the barrier; (ii) a first stabilizing member of a plastics material which is connected to the support member and has an elongate ground-engaging part which extends horizontally from the support member to an end which is remote from the support member; (iii) a second stabilizing member of a plastics material which is connected to the support member and has an elongate ground-engaging part which extends horizontally from the support member in a direction opposite to the elongate part of the first stabilizing member to an end remote from the support member; and (iv) an elongate stiffening member which is connected to the first stabilizing member and the second stabilizing member and extends horizontally from adjacent said end of the first stabilizing member, to adjacent said end of the second stabilizing member.

In embodiments of the various aspects of the invention, there is provided a base for a temporary barrier, comprising (i) a support portion of plastics material on which is provided an upwardly extending spigot or socket for engaging with a part of the barrier; (ii) first and second elongate, horizontally extending, ground engaging stabilizing members of plastics material connected to the support portion, the stabilizing members extending in diametrically opposite directions from the support portion to respective remote ends of the stabilizing members; and (iii) an elongate stiffening member which is connected to the first stabilizing member and to the second stabilizing member and extends horizontally from adjacent the remote end of the first stabilizing member to adjacent the remote end of the second stabilizing member.

In some embodiments, the remote ends of the first and second stabilizing members are provided with retaining portions which retain the stiffening member. In some embodiments, at least one of the first and second stabilizing members is provided with a resiliently deformable portion at its remote end so that the retaining portion can be moved to permit insertion of the stiffening member and can return subsequently to retain the stiffening member.

In some embodiments, the stiffening member passes through portions of the first stabilizing member and the second stabilizing member.

In some embodiments, the stiffening member is of fiber reinforced resin. In some embodiments, the stiffening member has been formed by a pultrusion process. In some embodiments, the stiffening member is in the form of a rod or tube.

In some embodiments, the first and second stabilizing members have rounded portions along their peripheries to reduce the hazard of tripping by pedestrians.

In some embodiments, the support portion and the stabilizing members are integrally formed of plastics material.

In some embodiments, the support portion is provided with a pair of laterally spaced spigots or sockets. In some embodiments, the support portion is provided with an assembly comprising a first upwardly projecting member, a second upwardly projecting member and an interconnecting member connecting the first and second upwardly projecting members, the interconnecting member being provided with a longitudinally extending passage through which the stiffening member passes, and the upwardly projecting members passing through the support portion and serving as the spigots or sockets. In some embodiments, the interconnecting member is hollow and defines the longitudinally extending passage. In some embodiments, the interconnecting portion is a box section having open ends. In some embodiments the interconnecting portion is provided with laterally extending flanges. In some embodiments, the upwardly projecting members and the interconnecting member are of metal.

In some embodiments, along the first and second stabilizing members there is provided a plurality of pairs of laterally spaced apertures whose lateral spacing matches the spacing of the laterally spaced spigots or sockets, the pairs being spaced by equal amounts so that the bases can be stacked in a longitudinally offset fashion with the spigots or sockets of one base passing through aligned apertures in the or each base above.

In some embodiments, there are provided two, laterally spaced stiffening members.

In some embodiments there are provided two, laterally spaced stiffening members, wherein there are provided two laterally spaced stiffening members and wherein the support portion is provided with an assembly comprising a first upwardly projecting member, a second upwardly projecting member and an interconnecting member connecting the first and second upwardly projecting members, the interconnecting member being provided with a first hollow member defining a longitudinally extending passage through which one stiffening member passes, and a second laterally spaced second hollow member defining a longitudinally extending passage through which the other stiffening member passes, and the upwardly projecting members passing through the support portion and serving as the spigots or sockets.

In some embodiments the stabilizing members are of low profile. In some embodiments the height of each stabilizing member over a major part of its length from its remote end, does not exceed 40 mm. In some embodiments the height of each stabilizing member over a major part of its length from its remote end, does not exceed 25 mm.

Embodiments of the invention provide a base for a temporary barrier which has a spigot or socket to receive a fencing pole or to cooperate with a plastics fencing panel. The base has a support portion of plastics material on which is provided the spigot or socket. A pair of stabilizing members of plastics material of low profile extending in opposite directions from the support portion. A stiffening member is connected to each stabilizing member and extends horizontally from adjacent the remote end of one stabilizing member to adjacent the remote end of the other stabilizing member. In one form a pair of metal tubes extend upwardly and are connected to a hollow metal portion through which the stiffening member passes. In another form, a plastics portion projects upwardly and defines a socket. The stiffening member may be of fiber reinforced resin and may be made by a pultrusion process.

What is claimed is:

1. A base for a temporary barrier, comprising:

a support portion of plastics material on which is provided an upwardly extending spigot or socket for engaging with a part of the barrier;

first and second elongate, horizontally extending, ground engaging stabilizing members of plastics material connected to the support portion, the stabilizing members extending in diametrically opposite directions from the support portion to respective remote ends of the stabilizing members; and an elongate stiffening member which is connected to the first stabilizing member and to the second stabilizing member and extends horizontally from adjacent the remote end of the first stabilizing member to adjacent the remote end of the second stabilizing member;

wherein at least one of the first and second stabilizing members is provided with a resiliently deformable portion at its remote end so that the retaining portion can be moved to permit insertion of the stiffening member and can return subsequently to retain the stiffening member.

2. The base of claim 1, wherein the remote ends of the first and second stabilizing members are provided with retaining portions which retain the stiffening member.

3. The base of claim 1, wherein the stiffening member passes through portions of the first stabilizing member and the second stabilizing member.

4. The base of claim 1, wherein the stiffening member is of fiber reinforced resin.

5. The base of claim 4, wherein the stiffening member has been formed by a pultrusion process.

6. The base of claim 1, wherein the stiffening member is in a form of a rod or tube.

7. The base of claim 1, wherein the first and second stabilizing members have rounded portions along their peripheries to reduce the hazard of tripping by pedestrians.

8. The base of claim 1, wherein the support portion and the stabilizing members are integrally formed of plastics material.

9. The base of claim 1, wherein the support portion is provided with a pair of laterally spaced spigots or sockets.

10. The base of claim 9, wherein the support portion is provided with an assembly comprising a first upwardly projecting member, a second upwardly projecting member and an interconnecting member connecting the first and second upwardly projecting members, the interconnecting member being provided with a longitudinally extending passage through which the stiffening member passes, and the upwardly projecting members passing through the support portion and serving as the spigots or sockets.

11. The base of claim 10, wherein the interconnecting member is hollow and defines the longitudinally extending passage.

12. The base of claim 11, wherein the interconnecting portion is a box section having open ends.

13. The base of claim 11, wherein the interconnecting portion is provided with laterally extending flanges.

14. The base of claim 10, wherein the upwardly projecting members and the interconnecting member are of metal.

15. The base of claim 1, wherein there are provided two, laterally spaced stiffening members.

16. The base of claim 1, in combination with a barrier panel.

17. The base of claim 1, in combination with at least one pole of a fencing system.

18. The base of claim 1, wherein the height of each stabilizing member over a major part of its length from its remote end, does not exceed 25 mm.

19. A base for a temporary barrier, comprising:

a support portion of plastics material on which is provided an upwardly extending spigot or socket for engaging with a part of the barrier;

first and second elongate, horizontally extending, ground engaging stabilizing members of plastics material connected to the support portion, the stabilizing members extending in diametrically opposite directions from the support portion to respective remote ends of the stabilizing members; and an elongate stiffening member which is connected to the first stabilizing member and to the second stabilizing member and extends horizontally from adjacent the remote end of the first stabilizing member to adjacent the remote end of the second stabilizing member;

wherein the support portion is provided with a pair of laterally spaced spigots or sockets wherein there are provided two laterally spaced stiffening members and wherein the support portion is provided with an assembly comprising a first upwardly projecting member, a second upwardly projecting member and an interconnecting member connecting the first and second upwardly projecting members, the interconnecting member being provided with a first hollow member defining a longitudinally extending passage through which one stiffening member passes, and a second laterally spaced second hollow member defining a longitudinally extending passage through which the other stiffening member passes, and the upwardly projecting members passing through the support portion and serving as the spigots or sockets.

* * * * *